US012704038B1

(12) United States Patent
Otaibi et al.

(10) Patent No.: US 12,704,038 B1
(45) Date of Patent: Aug. 11, 2026

(54) APPARATUS FOR THERMAL ACTIVATION OF BLOW-OUT PREVENTERS OF OIL AND GAS WELLS

(71) Applicant: SAUDI ARABIAN OIL COMPANY, Dhahran (SA)

(72) Inventors: Naser Otaibi, Khobar (SA); Hasan Alkhunizi, Qatif (SA); Amjad Alshaarawi, Khobar (SA); Aqeel Alshakhouri, Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/209,300

(22) Filed: May 15, 2025

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/061; E21B 33/062; E21B 33/063
See application file for complete search history.

(56) References Cited

U.S. PATENT DOCUMENTS 3,651,823 A * 3/1972 Milsted, Sr. ..... E21B 33/06 137/614.04
3,744,506 A * 7/1973 Milsted, Sr. ..... E21B 33/06 91/461
4,163,477 A * 8/1979 Johnson ..... E21B 29/08 137/263
4,840,346 A * 6/1989 Adnyana ..... E21B 33/064 60/528
2005/0189119 A1* 9/2005 Gynz-Rekowski ..... E21B 34/06 166/387
2006/0278281 A1* 12/2006 Gynz-Rekowski ..... G01M 3/2807 137/554
2016/0102520 A1* 4/2016 Noakes ..... E21B 29/04 166/250.01
2016/0312563 A1* 10/2016 Rytlewski ..... E21B 33/063
2016/0369603 A1* 12/2016 Hazel ..... E21B 33/124
2017/0073555 A1* 3/2017 Reddy ..... C08G 59/504
2019/0368300 A1* 12/2019 Maher ..... E21B 33/064

* cited by examiner

*Primary Examiner* — David Carroll
(74) *Attorney, Agent, or Firm* — Osha Bergman Watanabe & Burton LLP

(57) ABSTRACT

A system for containing well pressure including a well, a well casing, a blowout preventer (BOP), and a fuel container fluidly connected to the BOP that contains a fuel composition. The fuel composition auto ignites at a temperature between 150° F. and 1100° F. The fuel container of the system is configured to transfer heat from outside the fuel container to inside. A method for containing well pressure including heating a fuel container fluidly connected to a BOP and containing a fuel composition, autoigniting the fuel composition, producing a pressurized gas from a reaction activated by the autoignited fuel composition, directing the pressurized gas from the fuel container to a first volume of a ram casing of the BOP, expanding the pressurized gas in the first volume, driving the ram piston into a second volume of the ram casing, and driving a ram head or annular ram thereby sealing the well.

16 Claims, 5 Drawing Sheets

APPARATUS FOR THERMAL ACTIVATION OF BLOW-OUT PREVENTERS OF OIL AND GAS WELLS

BACKGROUND

As is known to those of ordinary skill in the art of drilling, water, oil, gas, and other commonly drilled-for materials are significantly less dense than the overlying rock and these substances are detained under said rock by at least a combination of impermeability of at least one overlying rock layer and a local maximum of said impermeable layer. Thus, when this overlying impermeable rock layer is pieced, for example by a well being drilled through, the water, oil, gas or other such substance is often forced upward through well and thus upward through any well casing disposed in the well. This is often undesirable particularly when drilling for oil and gas as the escaped oil or gas poses numerous safety and environmental hazards. Of particular significance is the hazard of fire since oil and gas are very commonly highly flammable. The uncontrolled release of oil, gas, or other such substance from a well is commonly known in the industry as a blowout. A primary technique to prevent blowouts is to fill the well casing with a dense substance known as drilling mud to counteract the upward force of the oil or gas. This is sometimes not sufficient and for those situations, one or more blowout preventers (BOP) are often positioned at intervals throughout the well and configured to seal the wellbore when activated. Accompanying a blowout may be a large fire resulting from the burning of escaped oil and/or gas which may disrupt attempts to activate the BOP such as by damaging hydraulic or electrical lines to power and/or communicate with the BOP. As such, there is need for an independent and automatic BOP that is activated by a fire from a well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for containing well pressure including a well, a well casing disposed in the well and extending a height above the well, and a blow out preventer (BOP). The system further includes a fuel container fluidly connected to the BOP. The fuel container contains a fuel composition that auto ignites at a temperature between 150° F. and 1100° F. The fuel container is configured to transfer heat from outside the fuel container to inside.

In another aspect, embodiments disclosed herein relate to a method for containing well pressure by heating a fuel container fluidly connected to a BOP and containing a fuel composition. The BOP is arranged at a top end of a well. The fuel composition is autoignited and a pressurized gas is produced from a reaction activated by the autoignited fuel composition. The pressurized gas is directed from the fuel container to a first volume of a ram casing of the BOP. The pressurized gas is expanded in the first volume to apply pressure to a ram piston disposed in the ram casing. The ram piston is driven into a second volume of the ram casing. A ram head or annular ram is driven, thereby sealing the wall.

Other aspects and advantages of the claimed subject matter will be apparent from the following description and the appended claims.

DETAILED DESCRIPTION

Figure 1:
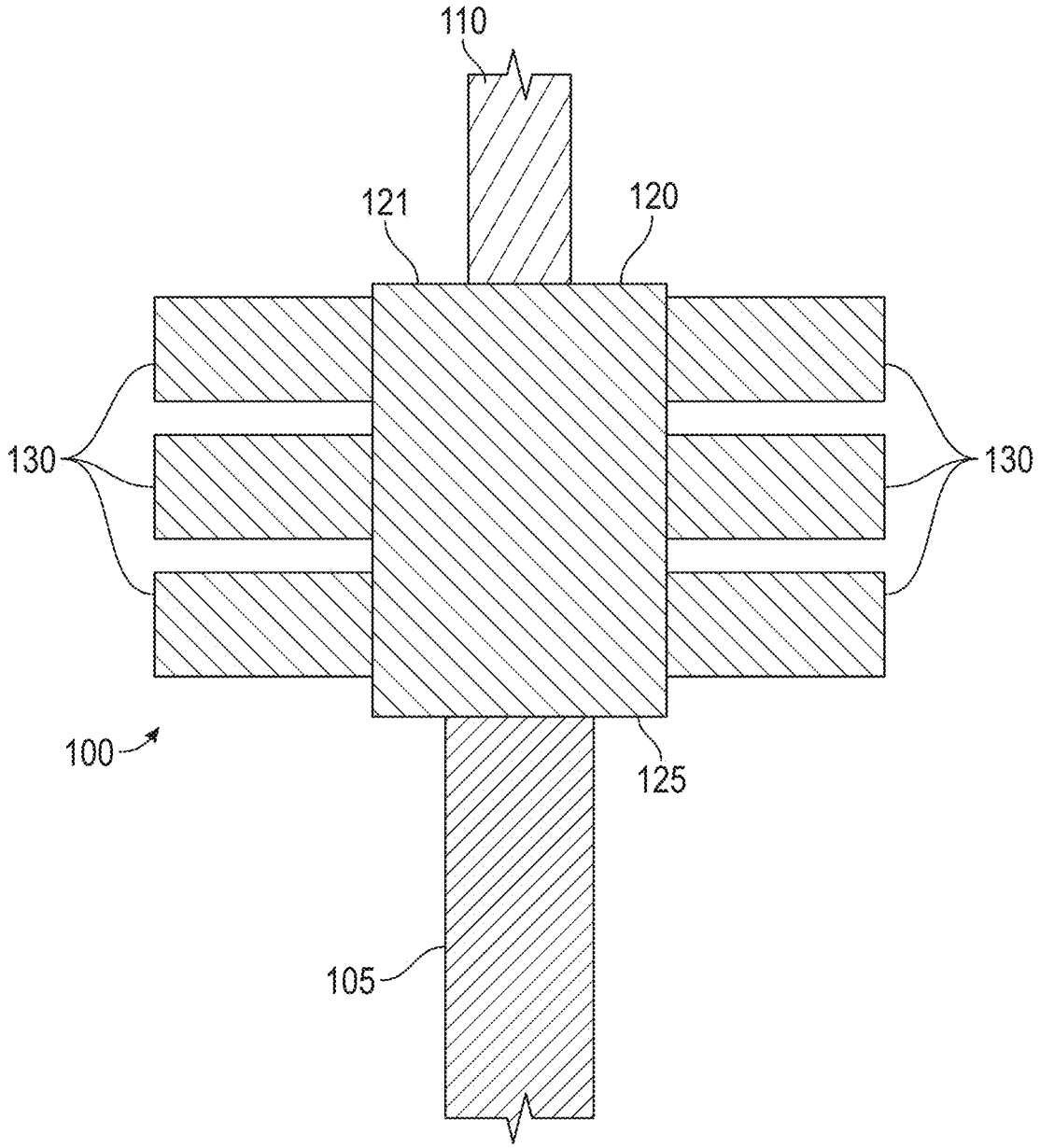
FIG. 1 shows a blowout preventer in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-6, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "an operator" includes reference to one or more of such operators.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

The present disclosure outlines a solution for sealing wells to prevent blowouts in case of emergency by providing a fuel composition that is able to autoignite in the presence of heat such as from an uncontrolled fire. Methods presented herein solve deficiencies in existing blowout preventers because the present system includes a fuel container containing a fuel composition that, when an uncontrolled fire is present in the vicinity of the blowout preventer, autoignites and produces a pressurized gas to active said blowout preventer to seal the well.

FIG. 1 shows a blowout preventer in accordance with one or more embodiments.

FIG. 1 shows an outside sidelong view of a BOP 100 arranged on a top end of a well casing 105 with a drill string 110 arranged through a bore of the BOP 100 and into the well casing 105 to drill the well. The bore of the BOP 100 extends from a first end 120 of the body 121 of the BOP 100 to an opposite second end 125 of the body 121 of the BOP 100. The well casing 105 extends a height above the well. The BOP 100 includes a number of ram casings 130 disposed on an outer surface of the body 121, which house the rams that are responsible for sealing the BOP bore and thus the well bore. Shown here is a six ram BOP 100 but the number, shape, and configuration of the ram casings 130 and rams may vary depending on the design chosen for the particular application. One or more BOPs 100 may be emplaced according to the knowledge of one of ordinary skill in the art. A drill string 110 may or may not be present in whole or in part depending on the exact situation.

Figure 2:
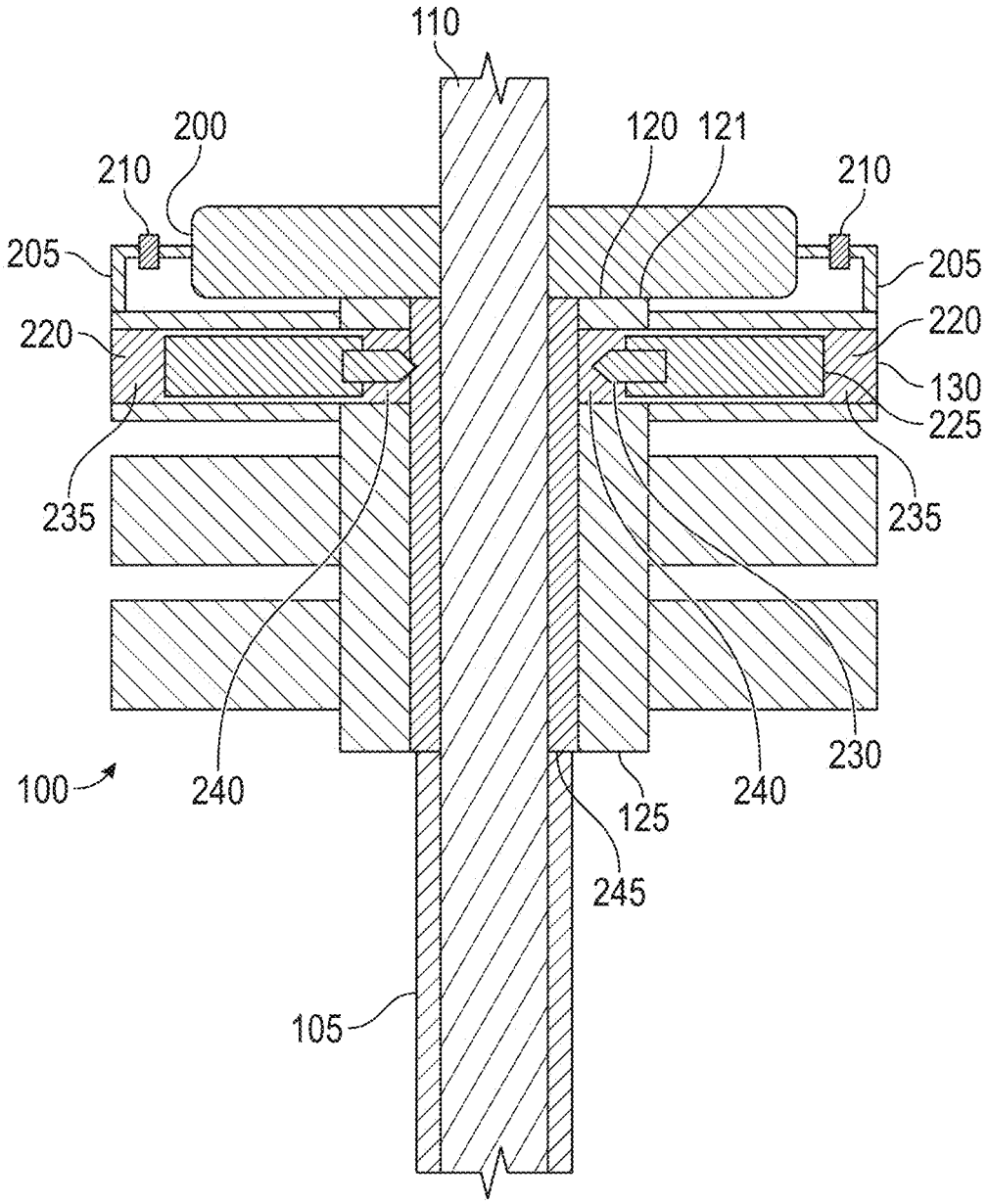
FIG. 2 shows a cutaway of a blowout preventer with a fuel container in accordance with one or more embodiments.

FIG. 2 shows a cutaway of a blowout preventer with a fuel container in accordance with one or more embodiments.

FIG. 2 shows a BOP 100 similar to that of FIG. 1 but with a fuel container 200 and lines 205 connecting the fuel container to two of the ram casings 130. Additional fuel containers 200 and lines 205 may be added for redundancy. FIG. 2 also shows the BOP with the uppermost ram casings 130, BOP body 121, and well casing 105 cutaway. Depending on the particular application, various sizes, quantities, and configurations of fuel container 200 and lines 205 may be employed to one, several, or all of the ram casings 130. Ram casings 130 not connected to a fuel container 200 may be alternately connected to and powered by any means known in the art such as hydraulic or electrical systems.

The fuel container 200 contains a fuel composition that is configured to autoignite when the composition reaches a certain temperature determined by the specific composition and generate a controllable amount of pressure. Such temperatures may be in the range of 150° F. and 1100° F. The fuel composition may be a hydrocarbon fuel mixed with oxygen, air, and/or an oxidizer. Suitable fuels include methane, ethane, and propane which may have auto-ignition temperatures at approximately 580° C., 515° C., and 480° C., respectively. When the fuel composition contains an oxidizer, this fuel composition generates heat in response to temperature changes. Simultaneously, the fuel container also contains a chemical (in a solid or liquid phase) that reacts to generate large volumes of gas when heated. Examples of the chemical include Sodium Azide ($NaN_3$). Sodium Azide, or a similar chemical, generates the expansion pressure in response to the generated heat from the fuel composition during the reaction. The BOP 100 shown in FIG. 2 also includes hydraulic pistons 210 on each line 205. When pressurized gas 215 is directed to the hydraulic pistons 210, the hydraulic piston 210 is configured to correspondingly pressurize a hydraulic fluid. The hydraulic piston 210 may provide mechanical advantage, mechanical disadvantage, or a 1:1 transfer of pressure between the pressurized gas and hydraulic fluid according to the exact configuration. If no hydraulic piston is used, the pressurized gas 215 expands into the first volume 235 and forces the ram 220 into the second volume 240.

Arranged in the ram casings 130 are rams 220 that include a ram piston 225 and a ram head 230. When pressure is supplied to a first volume 235 of the ram casing 130 such as from a pressurized hydraulic fluid (or pressurized gas if no hydraulic piston is used) being directed thereto, the ram 220 is driven into the second volume 240. The ram 220 is driven by the force of the hydraulic fluid or pressurized gas being forced into the first volume 235 of the ram casing 130. When the ram 220 is driven, the ram head 230 of the ram 220 is driven into the bore 245 of the body 121 of the BOP 100. When the ram head 230 is driven into the bore 245, the ram head 230 is configured to seal the well. Sealing the well may involve occluding the bore 245 of the BOP 100 with the ram head 230, cutting the drill string 110 with the ram head 230, crushing the drill string 110 with the ram head 230, and/or any other such mode of BOP 100 action as known in the art depending on the situation and configuration of ram head 230.

Connecting the ram piston 225 to the ram head 230 is a section known as the ram shaft 250. The closing ratio is defined as the cross-section area of the ram piston divided by the cross-section area of the ram shaft. The closing ratio determines the amount of pressure that needs to be applied to the ram piston 225 to drive the ram head 230 into the bore 245 for a given amount of pressure from the well. The closing ratio along with the pressure available to the BOP determine how much well pressure the BOP 100 is capable of containing. The closing ratio may be anywhere between 3 and 50, the pressure available from the autoignition of the fuel may be between 100 and 5000 psi, and thus the maximum well pressure containable by the BOP 100 from the well may be 3000 and 15000 psi. All pressures given are as gauge pressures relative to the ambient atmosphere, however, at the common operating pressures of a BOP 100, the difference between gauge and absolute pressure is negligible.

Figure 3:
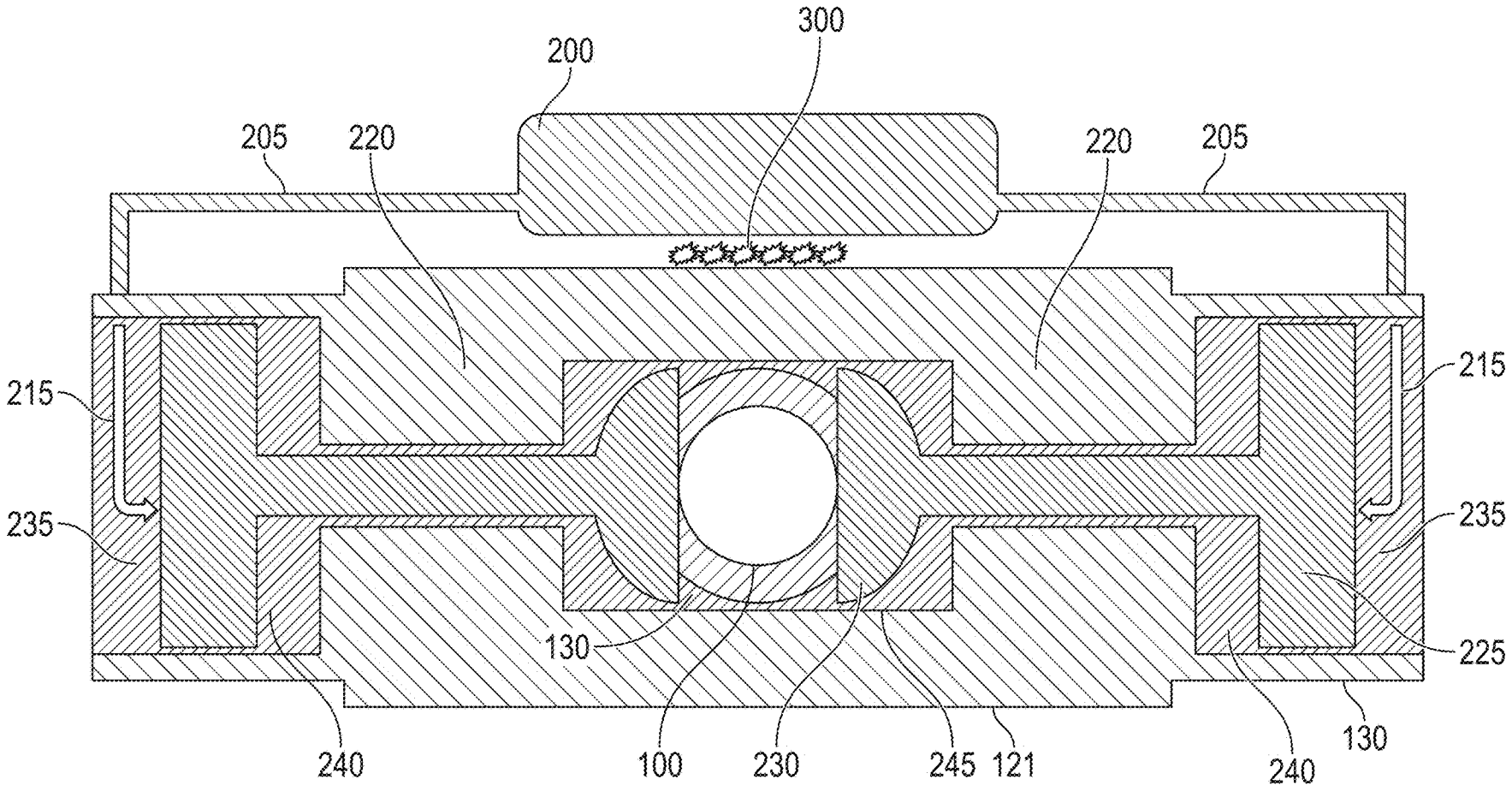
FIG. 3 shows a blowout preventer in fire conditions in accordance with one or more embodiments.

FIG. 3 shows a blowout preventer in fire conditions in accordance with one or more embodiments.

FIG. 3 shows a top down view of an example BOP 100 in a fire condition. A fire condition herein refers to a fire 300, heat, or significantly exothermic process in proximity to the BOP 100 and thus the fuel container 200. The fuel container 200 may be configured to effectively transmit heat applied from an outside region of the fuel container 200 to the fuel composition arranged in an inside region of the fuel container 200. In one or more embodiments, the heat being transmitted may originate from an uncontrolled fire 300 adjacent or nearly adjacent to the BOP 100. The transmission of heat into the fuel container 200 may be accomplished by the walls of the fuel container 200 being made, at least in part, of a thermally resistant yet thermally conductive material such as steel. The transmission of heat into the fuel container 200 may further or alternately be accomplished by a dedicated heat exchanger, heat sink, direct heater, or other such heat transmission device or technique as known in the art.

When sufficient heat has been generated by the fire 300, transmitted into the fuel container 200 and directed to the fuel composition, said fuel composition autoignites and produces a large amount of heat. This heat, in turn, activates the chemical reaction that converts the expanding power into pressurized gas 215 which is directed through lines 205 that fluidly connect either directly from the fuel container 200 to a first volume 235 of a ram casing 130 or from the fuel container 200 to a hydraulic piston 210 and from the hydraulic piston 210 to the first volume 235 of the ram casing 130.

Figure 4:
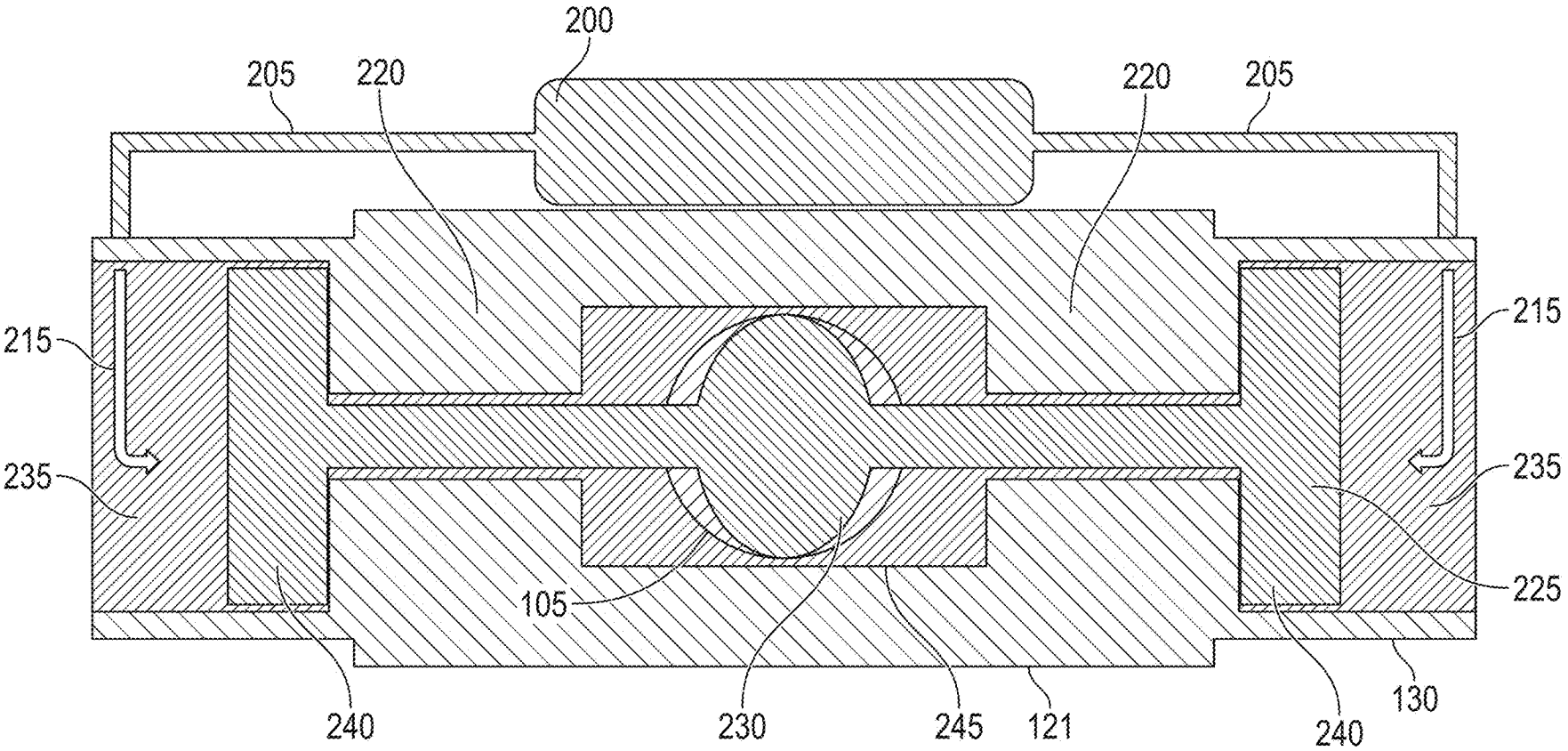
FIG. 4 shows a blowout preventer sealing a wellbore in accordance with one or more embodiments.

FIG. 4 shows a blowout preventer sealing a wellbore in accordance with one or more embodiments.

FIG. 4 shows the BOP 100 after activation, where the fuel composition has autoignited, and the resulting gas 215 has forced the ram pistons 225 from the first volume 235 to the second volume 240 and thus, the ram heads 230 have sealed the well bore via occlusion of said well bore. The BOP 100 may thus be spent and require replacement to bring the well back into operation.

Figure 5:
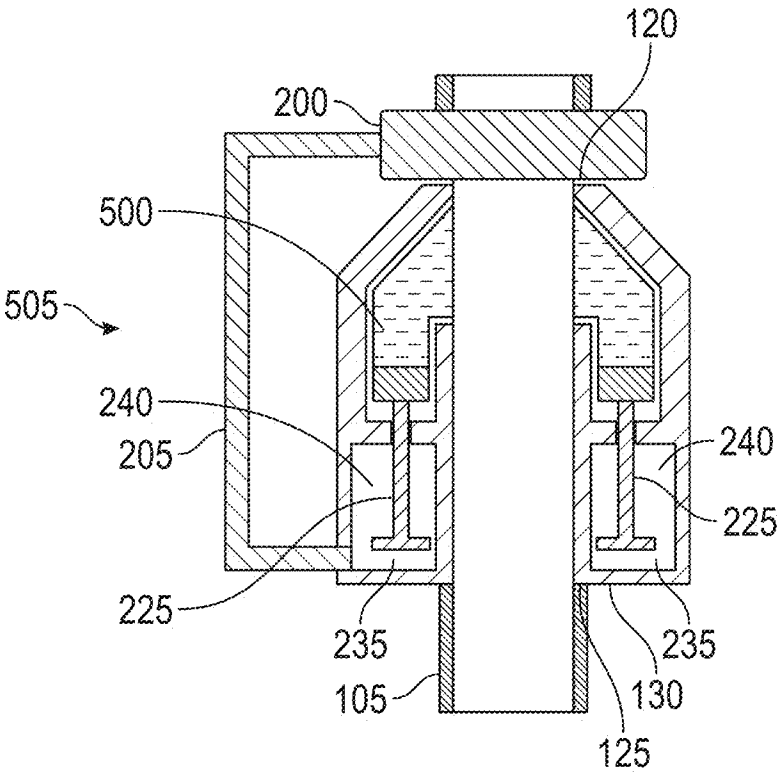
FIG. 5 shows an annular blowout preventer in accordance with one or more embodiments.

FIG. 5 shows an annular blowout preventer in accordance with one or more embodiments.

In an annular BOP 505, the ram casing 130 and ram piston 225 are arranged parallel to the well casing 105 as opposed to perpendicular in a standard BOP 100. The ram casing 130, ram piston 225 and annular ram 500 form continuous rings but in other embodiments, the ram casing 130 ram piston 225 and annular ram 500 may be arranged in discrete sets independently fluidly connected to the fuel container 200 and/or with the ram casings 130 being fluidly connected to each other with one or more being fluidly connected to the fuel container 200 by a line 205. The annular ram 500 may be a torus or number of torus segments or any similarly annular arrangement of a rubber, elastic, or otherwise mechanically similar material. An annular BOP 100 may be used alone or in conjunction with another type of BOP 100.

Figure 6:
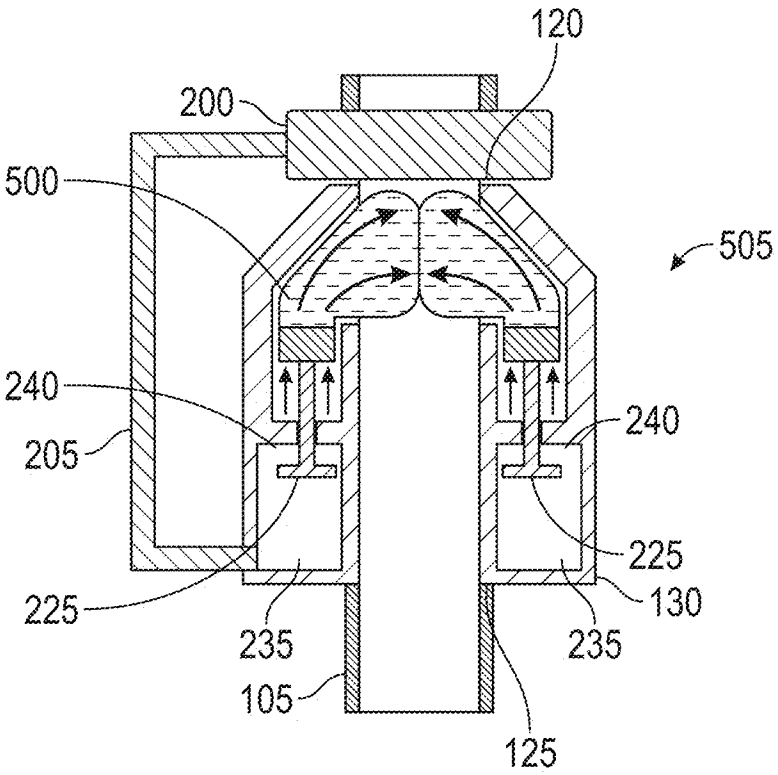
FIG. 6 shows an activated annular blowout preventer in accordance with one or more embodiments.

FIG. 6 shows an activated annular blowout preventer in accordance with one or more embodiments.

When an annular BOP 505 is activated, the fuel composition in the fuel container 200 autoignites and produces heat. Produced heat activates the reaction that produces pressurized gas 215. The pressurized gas 215 is directed through a line 205 to the first volume 235 of the ram casing 130. The ram pistons 225 are driven by the expansion of the pressurized gas 215 from a first volume 235 of the ram casing 130 to a second volume 240 and thereby drive a flexible annular ram 500 into the bore of the BOP 505 to seal the well. A hydraulic piston 210 may be incorporated in a similar fashion to the BOP 100 described regarding FIG. 2. The annular ram 500 provides the benefit of being able to conform to any obstruction in the bore 245 such as a drill string 110 or debris and still occlude the bore 245.

Embodiments of the present disclosure may provide at least one of the following advantages. The BOP 100, 505 being configured to activate in a fire condition by autoignition a fuel composition provides for automatic BOP 100, 505 activation in a case where manual activation is particularly difficult or impossible due to personnel danger and/or equipment damage. The BOP 100, 505 configured to activate in a fire condition may further protect the well from a fire originating from outside the well as opposed to from a blowout by sealing the well.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for containing well pressure,
the system comprising:
a well,
a well casing disposed in the well and extending a height above the well, and
a blowout preventer (BOP), comprising:
a body with a bore extending from a first end of the body to a second end of the body,
a ram comprising a ram piston and a ram head,
a ram casing disposed on an outer surface of the body,
a fuel container fluidly connected to the BOP, comprising a fuel composition,
wherein the fuel composition auto ignites at a temperature between 150° F. and 1100° F.,
wherein the fuel container is configured to transfer heat from outside the fuel container to inside,
wherein the ram is arranged with the ram piston in the ram casing and the ram head in the bore of the body,
wherein the fuel container is fluidly connected to the ram casing by a line.

2. The system of claim 1, wherein the BOP comprises:
a body with a bore extending from a first end of the body to a second end of the body,
a ram casing arranged on the body,
a ram comprising an annular ram and a ram piston,
wherein the ram is arranged with the ram piston in the ram casing and the annular ram in the bore of the body,
wherein the fuel container is fluidly connected to the ram casing by a line.

3. The system of claim 1, wherein the fuel composition further comprises an oxidizer.

4. The system of claim 1, wherein the fuel composition comprises methane, ethane, propane, and combinations thereof.

5. The system of claim 4, wherein the fuel composition further comprises oxygen, air, an oxidizer, or combinations thereof.

6. The system of claim 1, wherein the fuel container further comprises a chemical.

7. The system of claim 6, wherein the chemical is Sodium Azide.

8. The system of claim 1, wherein a maximum well pressure containable by the BOP is 15000 psig.

9. The system of claim 1, wherein a closing ratio of the BOP is between 3 and 50.

10. The system of claim 1, wherein a pressurized gas generated by the ignited fuel composition drives a hydraulic piston to generate a pressurized hydraulic fluid to power the BOP.

11. The system of claim 1, wherein the fuel container comprises at least one wall made of thermally conductive material.

12. A method for containing well pressure, the method comprising:

heating a fuel container fluidly connected to a BOP and containing a fuel composition, autoigniting the fuel composition, wherein the BOP is arranged at a top end of a well, producing a pressurized gas from a reaction activated by the autoignited fuel composition;

directing the pressurized gas from the fuel container to a first volume of a ram casing of the BOP;

expanding the pressurized gas in the first volume to apply pressure to a ram piston disposed in the ram casing;

driving the ram piston into a second volume of the ram casing; and driving a ram head or annular ram thereby sealing the well.

13. The method of claim 12, further comprises transmitting heat from an outside region of the fuel container to an inside region of the fuel container via heat from an uncontrolled fire adjacent to the BOP.

14. The method of claim 12, wherein sealing the well further comprises occluding a bore of the well with the ram head or an annular ram.

15. The method of claim 12, wherein sealing the well comprises crushing a drill string arranged inside the well with the ram head.

16. The method of claim 12, wherein sealing the well comprises cutting a drill string arranged inside the well with the ram head.

* * * * *